United States Patent [19]

Kadija

[11] Patent Number: 4,521,281

[45] Date of Patent: Jun. 4, 1985

[54] PROCESS AND APPARATUS FOR CONTINUOUSLY PRODUCING MULTIVALENT METALS

[75] Inventor: Igor V. Kadija, Cheshire, Conn.

[73] Assignee: Olin Corporation, New Haven, Conn.

[21] Appl. No.: 538,299

[22] Filed: Oct. 3, 1983

[51] Int. Cl.[3] ..... C25C 3/28; C25C 7/00

[52] U.S. Cl. ..... 204/25; 204/64 T; 204/64 R; 204/216; 204/228; 204/243 R; 204/246; 204/263; 204/265; 204/258

[58] Field of Search ..... 204/13, 25, 64 T, 64 R, 204/212, 258, 265, 263, 1 T, 243 R, 216, 246, 228, 67

[56] References Cited

U.S. PATENT DOCUMENTS

| | | | |
|---|---|---|---|
| 2,706,153 | 4/1955 | Glasser | 75/84 |
| 2,789,943 | 4/1957 | Kittelberger | 204/64 |
| 2,837,478 | 6/1958 | Ervin, Jr. et al. | 204/216 |
| 2,848,397 | 8/1958 | Reimert et al. | 204/64 |
| 2,864,749 | 12/1958 | Slatin | 204/64 |
| 2,893,935 | 7/1959 | Johns | 204/64 |
| 2,905,613 | 9/1959 | Tomonari et al. | 204/216 |
| 2,908,619 | 10/1959 | Barnett | 204/64 |
| 2,943,032 | 6/1960 | Benner | 204/64 |
| 2,975,111 | 3/1961 | Reimert et al. | 204/64 |
| 2,998,373 | 8/1961 | Snow | 204/246 |
| 3,019,174 | 1/1962 | Brenner et al. | 204/64 |
| 3,054,735 | 9/1962 | Johnson | 204/64 |
| 3,082,159 | 3/1963 | Reimert | 204/64 |
| 3,137,641 | 6/1964 | Slatin | 204/64 |
| 3,274,083 | 9/1966 | Snyder | 204/64 |
| 3,616,441 | 10/1971 | Priscu et al. | 204/247 |
| 3,662,047 | 5/1972 | Tokumoto et al. | 204/64 T |
| 3,764,493 | 10/1973 | Nicks et al. | 204/240 |
| 4,016,052 | 4/1977 | Tokumoto et al. | 204/64 T |
| 4,082,628 | 4/1978 | Tokumoto et al. | 204/64 T |
| 4,113,584 | 9/1978 | Johnson | 204/64 R |
| 4,115,213 | 9/1978 | Ogisu et al. | 204/39 |
| 4,116,801 | 9/1978 | Juckniess et al. | 204/247 |
| 4,118,291 | 10/1978 | Juckniess et al. | 204/64 T |
| 4,165,262 | 8/1979 | Juckniess et al. | 204/64 T |
| 4,167,468 | 9/1979 | Juckniess et al. | 204/64 T |
| 4,197,179 | 4/1980 | Ezzell et al. | 204/258 |
| 4,381,976 | 5/1983 | Armand | 204/64 T |
| 4,396,472 | 8/1983 | Armand | 204/246 |

*Primary Examiner*—R. L. Andrews

*Attorney, Agent, or Firm*—Barry L. Kelmachter; Howard M. Cohn; Paul Weinstein

[57] ABSTRACT

An electrolytic cell is described for continuously producing multivalent metals, in particular titanium and titanium alloys. The cell is physically separated into a plurality of zones to better control the stepwise reduction of the multivalent metal. To further increase control over the stepwise reduction process, each zone is also provided with a reference electrode for controlling the voltage potential at each cathode. A process for reducing and plating the multivalent metal is also described.

18 Claims, 4 Drawing Figures

PROCESS AND APPARATUS FOR CONTINUOUSLY PRODUCING MULTIVALENT METALS

The present invention relates to a process and apparatus for continuously producing metal, particularly titanium and titanium alloys.

Presently, titanium metal is produced in a batchwise manner either by chemical reduction of titanium tetrachloride with metallic magnesium or sodium (the Kroll process) or by electrolytically depositing titanium from a molten salt bath. U.S. Pat. No. 2,706,153 to Glasser briefly illustrates the chemical reduction process. While the chemical reduction process has been used commercially, the high cost associated with its use has caused much interest in the development of an economically feasible electrolytic process for producing titanium metal.

In the search for such an economically feasible process, a wide variety of electrolytic processes have been developed. U.S. Pat. Nos. 2,789,943 to Kittelberger, 2,848,397 to Reimert et al., 2,864,749 to Slatin, 2,893,935 to Johns, 2,975,111 to Reimert et al., 3,616,441 to Priscu et al., 4,016,052 to Tokumoto et al., 4,113,584 to Johnson, 4,115,213 to Ogisu et al., and 4,116,801 to Juckniess et al. illustrate some of the electrolytic processes that have been developed. In these processes, titanium tetrachloride generally is introduced into a molten alkali or alkaline earth metal salt bath, such as a mixture of potassium and lithium chlorides, in an electrolytic cell containing an anode, a cathode and means to supply metal ions to the bath. Metallic titanium is deposited on the cathode and chlorine gas is released at the anode.

There are several deficiencies to both the chemical reduction and the electrolytic processes used in the prior art. First, in both cases, the deposits tend to be spongy or granular. Second, the titanium metal reduction and nucleation are not controlled. Third, the processes are not cost efficient in that energy intensive processing is required prior to mill product manufacturing and in that the operations tend to be batchwise. For example, in the chemical reduction process, a considerable portion of energy is consumed to reduce $Mg^{++}$ and/or $Na^{+}$ in electrolytic cells in order to make them reusable for the process.

There have been some attempts in the prior art at a continuous metal production technique. U.S. Pat. Nos. 2,837,478 to Ervin, Jr. et al. and 2,905,613 to Tomonari et al. illustrate some of the approaches that have been taken towards continuous metal production. However, it is believed that neither of these approaches has enjoyed commercial acceptance.

In accordance with the present invention, a process and apparatus for continuously producing multivalent metals, particularly titanium or titanium alloys, that overcome many of the aforenoted deficiencies are described. The electrolytic cell of the present invention improves process efficiency and produces a relatively fine grained metallic deposit by controlling the stepwise reduction of the multivalent metal.

Control over the stepwise reduction is effected by physically separating the cell into a plurality of zones and by controlling the potential at the cathode in each zone. The physical separators between the zones help substantially prevent any bulk mixing of the electrolyte in adjacent zones while permitting transfer of a preferred metal species from zone to zone. In operation, a raw multivalent feed material such as gaseous $TiCl_4$ is introduced into a first zone. The multivalent metal in its highest oxidation state such as a Ti (IV) species is electrolytically reduced to a lower state of valency such as a Ti (III) species in the first zone. The lower valence state metal flows across the physical separator into a second zone where it is electrolytically reduced to a still lower state of valency such as a Ti (II) species. The still lower metal species then flows across another physical separator into a third or plating zone where it is electrolytically reduced and substantially continuously plated onto an endless surface cathode. The physical separators preferably comprise sponge-like, nonmetallic structures having sufficient thickness to prevent bulk mixing of electrolytes in adjacent zones.

The cell of the present invention also makes use of a porous gas diffusion electrode to increase the raw material feed rate into the cell. In addition to increasing the feed rate, this type of electrode increases the rate at which the incoming multivalent metal species is reduced. By increasing the feed and reduction rates in the first zone of the cell, overall process efficiency and metal production is increased.

While the cell has particular utility in producing titanium and titanium alloys, it may be used to produce other multivalent metals. As used herein, multivalent metals are characterized by having at least two possible valence levels when ionized. Exemplary of such metals are vanadium, chromium, manganese, iron, cobalt, nickel, zirconium, niobium, molybdenum, ruthenium, iridium, and tantalum.

Accordingly, it is an object of the present invention to provide an electrolytic cell suitable for the production of titanium, titanium alloys and other multivalent metals and their alloys.

It is a further object of the present invention to provide an electrolytic cell as above for substantially continuously producing high quality metal and metal alloys.

It is a further object of the present invention to provide a process for operating the above electrolytic cell.

It is a further object of the present invention to provide a process as above having improved efficiency and improved control over the step-by-step reduction of the metal being reduced.

These and further objects will become apparent from the following description in which like reference numerals designate like elements.

In accordance with the present invention, an improved electrolytic cell suitable for the production of multivalent metals, particularly titanium and titanium alloys, is provided. While the following description refers to the production of titanium and titanium alloys, the description also applies to other multivalent metals and their alloys.

Figure 1:
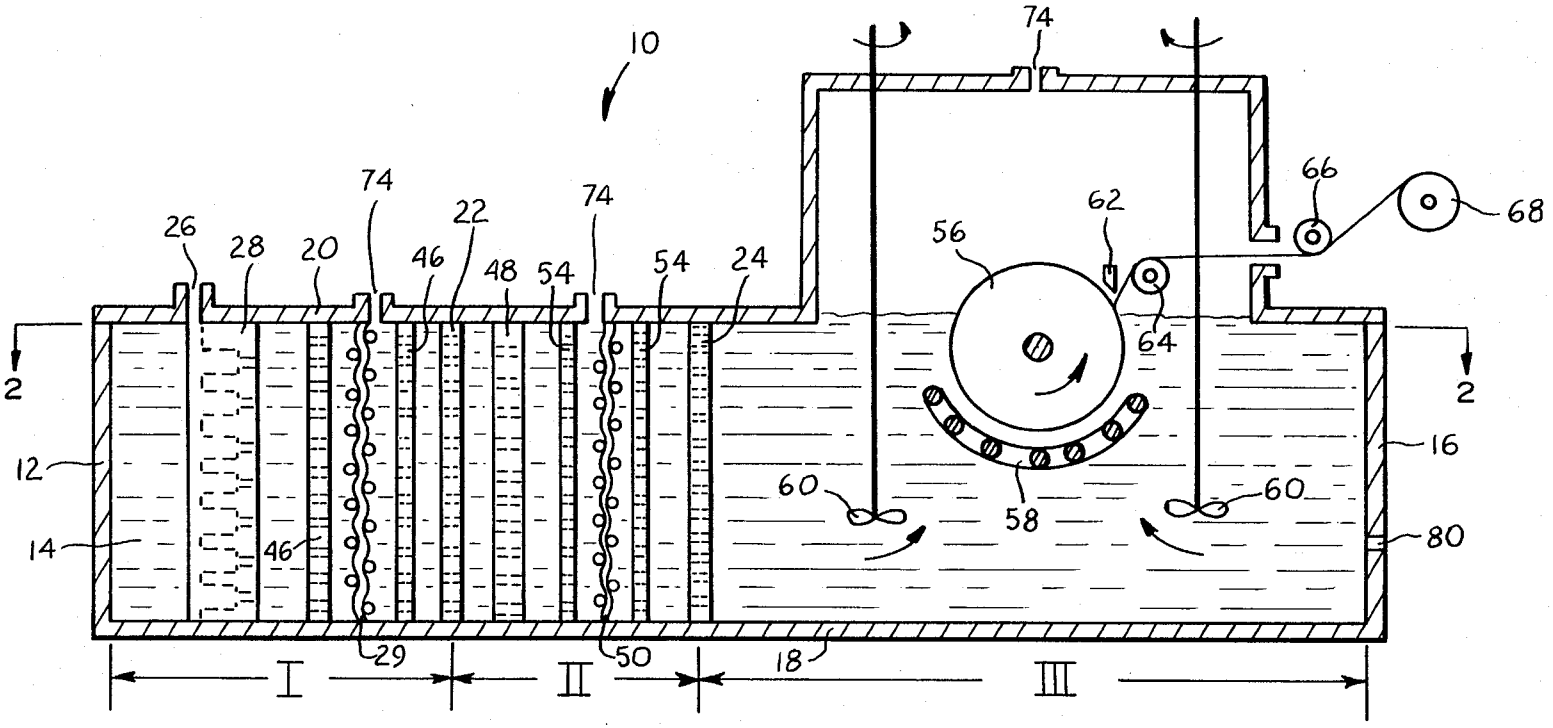
FIG. 1 is a side view of the electrolytic cell of the present invention.
Figure 2:
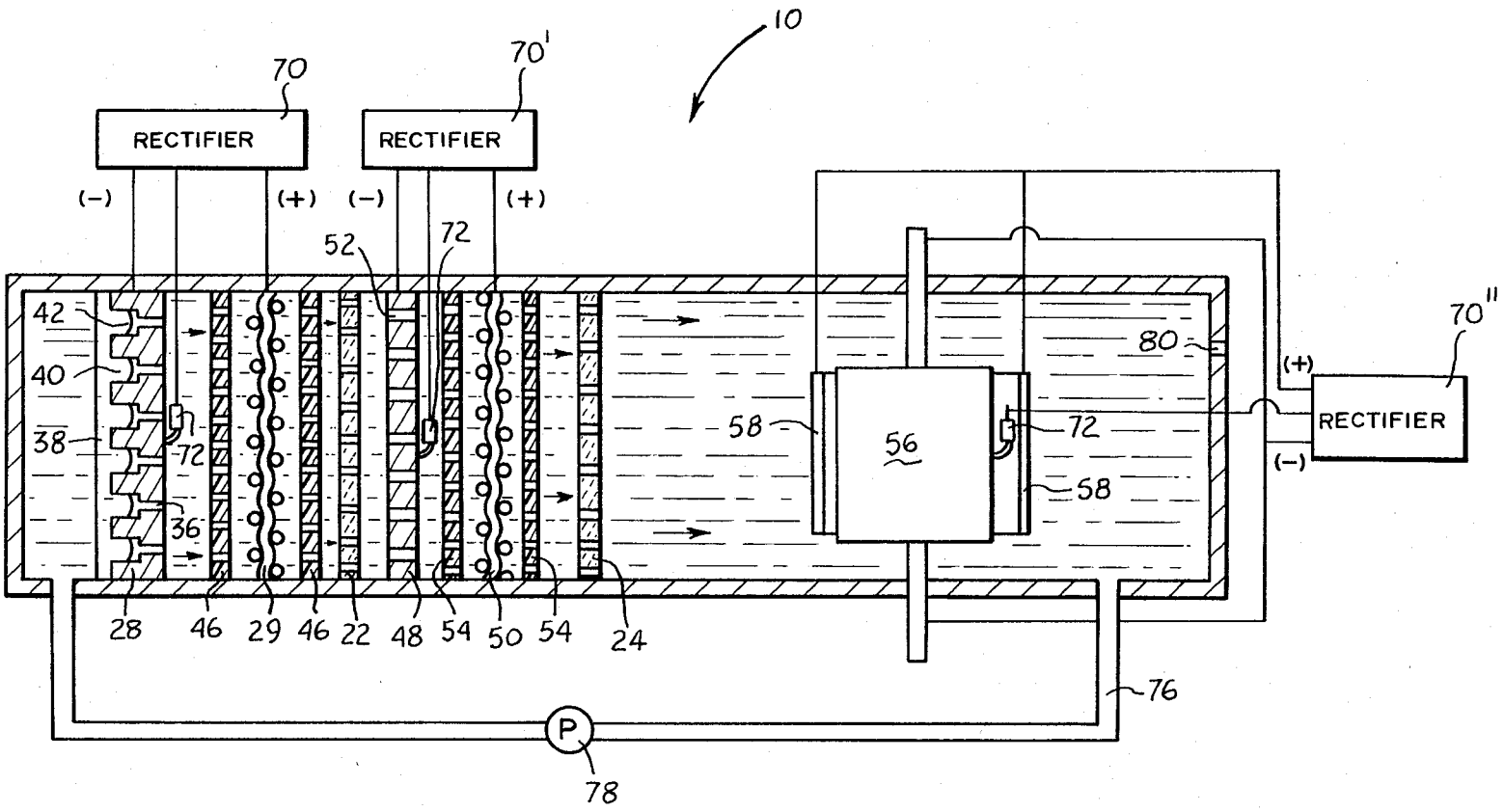
FIG. 2 is a sectional view along lines 2—2 of FIG. 1.
Figure 3:
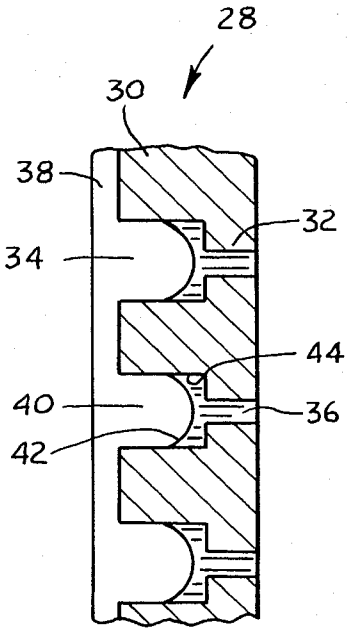
FIG. 3 is an exploded view of the feed cathode used in the cell of the present invention.

Referring now to FIGS. 1-3, the electrolytic cell 10 of the present invention is illustrated. The cell 10 includes a container 12 formed from a material that is capable of resisting the corrosive effects of a fused halide salt electrolyte 14. A suitable material from which the container 12 may be formed is a nickel-base iron-containing alloy. If needed to resist corrosion, the sidewalls 16 and bottom 18 of the container 12 may be lined with a suitable refractory material not shown. The top of the container is preferably closed by a metal cover 20. The cover 20 may be formed from the same material as the container 12.

The electrolyte 14 comprises a fused or molten salt which acts as a solvent for the multivalent metal compound. Suitable salts or mixtures thereof include LiCl, KCl, $AlCl_3$, NaCl, LiCl-KCl, LiCl-KCl-NaCl and LiCl-KCl-$CaCl_2$. When titanium is to be recovered from titanium tetrachloride, the fused bath preferably contains a mixture of alkali or alkaline earth metal halides, most preferably lithium and potassium chlorides. An eutectic mixture of the salts employed in the bath is advantageous because of the low melting temperature of such a mixture.

The compounds of titanium that can be used in the electrodeposition of titanium metal are limited. The oxides are generally unsuitable due to limited solubility in common solvents such as chlorides and failure to readily ionize and conduct. The halides are useful and acceptable. They can be separated from their oxides readily and can be maintained after purification. A preferred halide for the electrodeposition technique of the present invention is titanium tetrachloride $TiCl_4$.

So that improved control can be maintained over the stepwise reduction of the multivalent metal from its highest oxidation state, the cell 10 is separated into three zones I, II and III by physical separators 22 and 24. The construction of the separators 22 and 24 will be discussed in detail hereinafter. The titanium tetrachloride is introduced into zone I of the cell 10 preferably in gaseous form. The titanium tetrachloride enters the cell through inlet 26 which may extend through either one of the sidewalls 16 or the cover 20.

In zone I of the cell, the Ti (IV) species, the titanium tetrachloride, is electrolytically reduced to a Ti (III) species, $TiCl_3$, at the cathode 28 while chlorine gas is produced at the anode 29. The reaction may be written as follows:

$$2TiCl_4 \rightarrow 2TiCl_3 + Cl_2 \uparrow \quad (1)$$

The cathode 28 preferably comprises a porous gas diffusion electrode. This type of electrode is preferred for the cathode in zone I because it allows higher feed and reduction rates and three phase contact with maximum charge transfer efficiency. As a result, the production of the Ti (III) species, $TiCl_3$, should occur at a higher rate than if other conventional types of cathodes were used.

The porous cathode 28 is generally formed from a metallic material in powder form. The metallic material selected should be capable of surviving a relatively strong chlorine attack. Suitable metallic materials from which the cathode 28 can be formed include nickel-base and cobalt-base materials. The cathode 28 preferably has a portion 30 formed by a coarse metallic powder, a portion 32 formed by a fine metallic powder, and a plurality of pores 34 extending across substantially its entire width. Each pore 34 has a reduced cross-sectional area or necked down portion 36 in the fine powder portion 32 of the cathode as compared to the inlet portion 40 of the pore in the coarse portion.

During operation of the cell 10, the gaseous titanium tetrachloride $TiCl_4$ enters the cathode 28 through a passageway 38 communicating with the inlet 26. From the passageway 38, the $TiCl_4$ gas enters the inlet portion 40 of each pore 34. The necked down portion 36 of each pore is in communication with the electrolyte bath 14. As best shown in FIG. 3, a meniscus 42 forms in each pore at the interface between the gaseous $TiCl_4$ and the liquid electrolyte bath. Along the meniscus 42, the gaseous $TiCl_4$ diffuses through the liquid onto the surface 44 of the solid metal portion of the cathode 28 where it is reduced. On the surface 44, the $TiCl_4$ transfers an electron and is reduced to a Ti (III) species, $TiCl_3$, which then diffuses into the bulk solution.

The anode 29 in the zone I is also formed from a material resistant to the corrosive effects of the bath and to the elemental chlorine formed at the anode during the cell operation. Suitable anode materials include carbon and graphite; however, in a preferred construction, the anode 29 comprises a metallic mesh such as a copper mesh.

To avoid reoxidation of the Ti (III) species back into the Ti (IV) species, the anode 29 is surrounded by a microporous separator or diaphragm 46. The diaphragm 46 also prevents the elemental chlorine from going back into the bath solution. The diaphragm 46 can be made from organic synthetic materials such as a Nafion membrane, inorganic-like ceramic materials or fine metal meshes.

To substantially avoid any bulk mixing of the electrolyte in zone I with the electrolyte in zone II, the physical separator 22 is placed between zone I and zone II. Bulk mixing can be caused by convective currents or mechanical currents in the electrolyte bath. By substantially preventing bulk mixing of the electrolyte, it is possible to maintain a substantially laminar flow in both zones I and II. A laminar flow is desirable because it permits better control over the reduction of the Ti species in each zone.

The physical separator 22 is preferably a sponge-like structure having sufficient porosity to allow flow of Ti (III) species and electrolyte from zone I to zone II. The manner in which the flow of Ti (III) species across the separator 22 is created will be discussed later on. The separator 22 is also thick enough to substantially prevent the undesired mixing. In a preferred construction, the separator 22 is about ½" thick and has openings sized from about 8 to about 10 mesh. Since the physical separator 22 does not act as an electrode, it is preferably formed from a non-metallic material such as a ceramic.

In zone II of the cell, the Ti (III) species, $TiCl_3$, from zone I is electrolytically reduced to a Ti (II) species, $TiCl_2$, at the cathode 48 while elemental chlorine is again produced at the anode 50. The reaction in zone II may be written as follows:

$$2TiCl_3 \rightarrow 2TiCl_2 + Cl_2 \uparrow \quad (2)$$

Since the main objective in zone II is to convert the Ti (III) species into the Ti (II) species, the cathode 48 has a simpler configuration than the cathode 28. The cathode 48 preferably comprises a sintered porous cathode having pores 52 through its width. Each pore 52 preferably has a substantially constant cross-sectional area along its length. The material from which the cathode 48 is formed should be resistant to attack by both chlorine and the electrolyte bath. In a preferred construction, the the cathode 48 is formed from either a nickel-base or a cobalt-base material.

While the anode 50 may have any suitable construction, it preferably has the same construction as the anode 29. For the same reasons as in zone I, the anode 50 is preferably bagged in a microporous separator or diaphragm 54. As before, the diaphragm 54 may be made from organic synthetic materials, inorganic-like ceramic materials or fine metallic meshes.

To substantially prevent the electrolyte in zone II from any mixing in bulk with the electrolyte in zone III and to help maintain a substantially laminar flow across zone II, a physical separator 24 is placed between zones II and III. While the physical separator 24 may have any suitable construction, it preferably is identical to the physical separator 22. Again, the manner in which the Ti (II) species flows across the separator 24 will be discussed hereinafter.

In zone III of the cell, the Ti (II) species, $TiCl_2$, is electrolytically reduced to metallic titanium and continuously plated onto a cathode 56. Since the Ti (II) species is $TiCl_2$, elemental chlorine will again be produced at the anode 58. The reaction in zone III may be written as follows:

$$2TiCl_2 \rightarrow 2Ti + 2Cl_2 \uparrow \quad (3)$$

While in zones I and II it is desirable to maintain a substantially laminar flow to help control the stepwise reduction of the multivalent metal species, a turbulent flow is preferred in zone III so that fresh metal species can be presented to the cathode 56. To this end, one or more impellers 60 are placed in the cell 10 and are rotated by suitable drive means not shown. The impeller drive means may comprise any conventional drive means known in the art such as a motor.

Since the cell 10 is intended to provide continuous metal production, the cathode 56 preferably comprises a rotating drum. The rotating drum may comprise either a unitary drum structure or a base structure having a suitable plating surface attached thereto. In a preferred construction, the cathode 56 comprises a stainless steel or graphite drum. Any suitable means (not shown) known in the art such as a drive motor may be used to rotate the drum.

The anode 58 may have any suitable anode construction known in the art. Preferably, the anode 58 has a perforated construction. A perforated anode is preferred so that improved electrolyte mixing and substantially uniform plated metal composition can be achieved in the plating zone. The anode 58 may be formed from any suitable material such as carbon plate or graphite. While not completely necessary, the anode 58 may be bagged in a suitable diaphragm not shown. If used, the diaphragm may have a construction similar to that of diaphragms 46 and 54.

To remove the metal from the rotating drum 56, a scraping mechanism 62 is mounted in cell 10. The scraping mechanism 62 may comprise any suitable device known in the art such as a knife blade and may be mounted in the cell in any suitable fashion. After the metal has been peeled from the drum 56, it is passed over rolls 64 and 66 onto a suitable take-up reel 68.

Since plating of the titanium onto the cathode 56 depletes the supply of titanium in the plating zone bath, it becomes necessary to withdraw the depleted solution and provide new solution with fresh Ti (II) species. To this end, the depleted solution is withdrawn from plating zone III and recirculated to zone I via passageway 76 and pump 78. The flow pattern created by the passageway 76 and pump 78 also causes flow of the Ti (III) species across the separator 22 and flow of the Ti (II) species across the separator 24. Some flow of the Ti species across the separators 22 and 24 will also be caused by differences in the titanium species concentrations in the zones.

Any suitable means known in the art may be used to provide electrical current to the cathode and the anode in each zone. For example, the cathode and anode in each zone may each be electrically connected in a conventional manner to a suitable power source such as rectifiers 70, 70' and 70''.

It is important to smooth operation of the cell 10 that the reduction of the multivalent metal species in each zone be carefully controlled. To this end, a reference electrode 72 is placed adjacent the cathode in each zone. The reference electrode 72 in each zone allows the potential at each of the cathodes to be monitored. For example, the potential at the cathode 28 should not reach a level where the Ti (III) species in zone I is reduced to a Ti (II) species. Similarly, the potential at the cathode 48 should not reach the level where the Ti (II) species is reduced into metallic titanium. By monitoring the cathode potential and making any necessary adjustments to the power source, smooth stepwise reduction of the multivalent metal species can occur across the cell.

While the cell 10 may have any suitable atmosphere, it is preferred that an inert gas atmosphere such as argon or helium be used in the cell. Each zone of the cell 10 also has an outlet 74 through which chlorine gas produced at the anode may be removed.

If desired, a titanium alloy may be deposited onto cathode 56 in lieu of titanium metal. To this end, an inlet 80 is provided for feeding an alloying metal into plating zone III. For example, a suitable aluminum addition may be added to zone III to form a Ti6Al alloy. Titanium alloys may also be formed by altering the composition of the electrolyte bath. For example, if $AlCl_3$ forms part or all of the electrolyte bath 14, a titanium-aluminum alloy can be deposited onto the cathode 56.

The various cell operating parameters are dependent in large part upon the type of electrolyte bath used. For example, the bath temperature may be as low as 200° C. if $AlCl_3$ is used as an electrolyte or as high as 900° C. for some NaCl or KCl baths. The potential for the cathode in each zone is also dependent upon electrolyte composition. Assuming the electrolyte is a 1:1 KCl-NaCl bath, the cathode potential in zones I, II and III should be about 0.5V, 1.7V and 1.95V, respectively.

While the cathode 56 has been described as being a rotating drum, it may also comprise an endless belt or a removable cathode.

Figure 4:
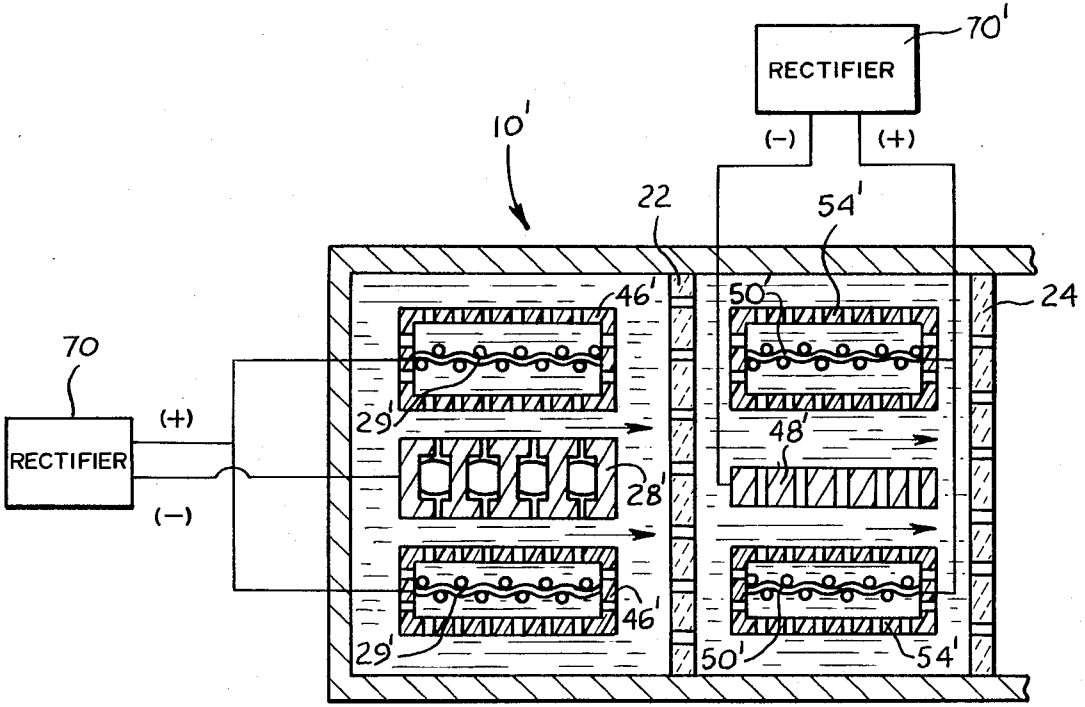
FIG. 4 is an alternative embodiment of a portion of the cell of the present invention.

While the cathode and anode in each zone have been illustrated in FIGS. 1–3 as being substantially perpendicular to the electrolyte flow direction, it is possible to arrange some or all of the anodes and cathodes substantially parallel to the electrolyte flow direction. The cell 10' partially illustrated in FIG. 4 has the anodes 29' and 50' and the cathodes 28' and 48' in zones I and II, respectively, arranged substantially parallel to the electrolyte flow direction. If desired, zones I and II of the cell 10' could each be provided with a plurality of anodes not shown and cathodes not shown arranged substantially parallel to the electrolyte flow direction.

If desired, a titanium alloy such as Ti6Al4V alloy sheet metal may be produced using two electrolytic cells not shown with a common plating zone III. In one of the cells, a first multivalent metal such as titanium is electrolytically reduced in steps from its highest valency state, e.g. a Ti (IV) species, to a lower species suitable for plating, e.g. a Ti (II) species. In the second cell, a second multivalent metal such as vanadium is electrolytically reduced in steps from its highest valency state, e.g. a V (IV) species, to a lower species suitable for plating, e.g. a V (II) species. Both lower species, e.g. the Ti (II) species and the V (II) species, are fed into the common plating zone where they are both plated onto the cathode. If needed, another alloying addition, e.g. aluminum, may be through a suitable inlet in the common plating zone.

While the anode 58 in the plating zone III has been described as preferably being a perforated anode, it is possible that anode 58 could be a single piece anode if fresh metal species can substantially continuously be provided to the plating cathode 56 by the impellers 60.

The various anodes, cathodes, diaphragms and physical separators may be mounted in the cell 10' in any conventional manner using any conventional supporting and mounting devices not shown known in the art.

The patents set forth in the specification are intended to be incorporated by reference herein.

It is apparent that there has been provided in accordance with this invention a process and apparatus for continuously producing multivalent metals which fully satisfy the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A process for continuously producing a multivalent metal, said process comprising:

providing a cell having at least one non-metallic porous barrier for separating said cell into a plurality of zones;

introducing a metal species having a first state of valency into one of said zones;

electrolytically reducing said first metal species to a species having a next lower state of valency in said one zone;

passing said species having said next lower state of valency through said at least one non-metallic porous barrier into another of said zones; and substantially continuously plating said metal onto a cathode in said another zone.

2. The process of claim 1 further comprising:

electrolytically reducing said species having said next lower state of valency to a species having a still lower state of valency; and said step of electrolytically reducing said species having said next lower state of valency being performed in a zone intermediate and distinct from said one zone and said plating zone.

3. The process of claim 2 further comprising:

providing an electrolyte bath in each zone; and said introducing step comprising introducing said metal species having said first state of valency into said one zone in gaseous form.

4. The process of claim 3 further comprising:

providing a porous gas diffusion cathode in said one zone; and said step of electrolytically reducing said metal species having said first state of valency comprising diffusing said metal species having said first state of valency into said bath in said one zone and reducing said species to said next lower state species with said cathode by applying a first current across said one zone.

5. The process of claim 2 further comprising:

said introducing step comprising introducing a Ti (IV) species into said one zone;

said electrolytic reducing steps comprising reducing said Ti (IV) species to a Ti (III) species in said one zone and reducing said Ti (III) species to a Ti (II) species in said intermediate zone; and said plating step comprising plating titanium onto said cathode.

6. The process of claim 5 further comprising:

said cathode in said plating zone comprising a rotating drum cathode; and said plating step comprising substantially continuously plating said titanium onto said drum.

7. The process of claim 3 further comprising:

providing a cathode in each zone; and monitoring the potential at each cathode for improving control over the stepwise reduction of said metal species.

8. An apparatus for continuously producing a multivalent metal, said apparatus comprising:

a cell;

means in said cell for electrolytically reducing said multivalent metal in a stepwise fashion from a first multivalent species to a species having a valency state from which said metal may be produced;

said reducing means comprising a first zone in said cell having means for electrolytically reducing said multivalent metal from said first species to a species having a next lower state of valency and a plating zone in said cell containing a cathode upon which said multivalent metal is substantially continuously plated; and said first zone and said plating zone being separated by at least one non-metallic porous barrier.

9. The apparatus of claim 8 further comprising:

each zone containing an electrolyte bath; and said barrier substantially preventing bulk mixing of said electrolyte bath in each zone with said electrolyte bath in an adjacent zone.

10. The apparatus of claim 9 wherein each said barrier comprises:

a sponge-like physical separator having sufficient thickness to prevent said bulk mixing and sufficient porosity to permit flow of said metal species across said separator in a desired direction.

11. The apparatus of claim 10 further comprising:

said cell having three zones;

said first zone containing said means for electrolytically reducing said multivalent metal from said first species to said species having said next lower state of valency;

a second zone adjacent said first zone containing means for electrolytically reducing said metal species having said next lower state of valency to said species having said valency state from which said metal may be produced; and said plating zone comprising a third zone adjacent said second zone where said species in said valency state from which said metal may be produced is electrolytically reduced and plated onto said cathode.

12. The apparatus of claim 11 further comprising:

said first and second zones each having a cathode and an anode; and said third zone having an anode and said cathode.

13. The apparatus of claim 12 further comprising:

said anode in each of said first and second zones being substantially surrounded by a microporous separator, said microporous separators subtantially preventing oxidation of said metal species in said next lower valency state back into said first metal species in said first zone and oxidation of said species having said valency state from which said metal may be produced back into said next lower valency state metal species in said second zone.

14. The apparatus of claim 12 further comprising:

means for introducing said multivalent metal species into said first zone in gaseous form;

said cathode in said first zone comprising a porous gas diffusion electrode having a plurality of pores;

each of said pores having an inlet portion communicating with said gaseous metal species and a necked-down portion communicating with said electrolyte bath in said first zone, whereby upon applying a current across said first zone, said gaseous metal species transfers an electron and is reduced to said species having said next lower valency state.

15. The apparatus of claim 12 wherein:

said cathode in said second zone comprising a porous cathode.

16. The apparatus of claim 12 further comprising:

said anode in said plating zone being a perforated anode; and said cathode in said plating zone comprising a rotating drum.

17. The apparatus of claim 12 further comprising:

each of said anodes and cathodes being connected to a power source; and each zone having a reference electrode located adjacent said cathode in said zone, said reference electrode monitoring the potential at each said cathode.

18. The apparatus of claim 12 further comprising:

said first metal species comprising a Ti (IV) species;

said Ti (IV) species being electrolytically reduced to a Ti (III) species in said first zone;

said Ti (III) species being electrolytically reduced to a Ti (II) species in said second zone;

said Ti (II) species being electrolytically reduced to titanium in said plating zone; and said titanium being plated onto said cathode in said plating zone.

* * * * *